United States Patent [19]

Perrissoud

[11] Patent Number: 4,905,385

[45] Date of Patent: Mar. 6, 1990

[54] ALPINE SKI BOOT

[75] Inventor: Claude Perrissoud, Saint-Jorioz, France

[73] Assignee: Salomon S.A., Annecy, Cedex, France

[21] Appl. No.: 239,262

[22] Filed: Sep. 1, 1988

[30] Foreign Application Priority Data

Sep. 2, 1987 [FR] France ..... 87 12650

[51] Int. Cl.[4] ..... A43B 5/04

[52] U.S. Cl. ..... 36/120; 36/121

[58] Field of Search ..... 36/117–121, 36/54

[56] References Cited

U.S. PATENT DOCUMENTS

| | | | |
|---|---|---|---|
| 3,868,783 | 3/1975 | Caporicci | 36/120 |
| 4,599,813 | 7/1986 | Sartor | 36/117 |
| 4,622,765 | 11/1986 | Baratto et al. | 36/120 |
| 4,667,424 | 5/1987 | Sartor et al. | 36/120 |
| 4,733,484 | 3/1988 | Delery | 36/120 |

FOREIGN PATENT DOCUMENTS

| | | |
|---|---|---|
| 071055 | 2/1983 | European Pat. Off. . |
| 133237 | 2/1985 | European Pat. Off. . |
| 166213 | 1/1986 | European Pat. Off. . |
| 174000 | 3/1986 | European Pat. Off. . |
| 205127 | 12/1986 | European Pat. Off. . |
| 2276850 | 1/1976 | France . |

*Primary Examiner*—James Kee Chi

*Attorney, Agent, or Firm*—Sandler & Greenblum

[57] ABSTRACT

An alpine ski boot includes a rigid shell base for receiving the foot of the skier, the base having a heel region and a instep region. An upper is journalled on the base for pivotal movement about a journal axis, the upper having a shoulder thereon cooperable with adjustment apparatus for controlling the advance angle of the upper on the base. The adjustment apparatus includes a first stopping element positioned on the base and cooperable with the shoulder for defining the minimum initial advance angle of the upper. The adjustment apparatus also includes an adjustment for adjusting the position of the stopping element on the base to thereby adjust the initial minimum advance angle of the upper.

76 Claims, 11 Drawing Sheets

ALPINE SKI BOOT

BACKGROUND OF THE INVENTION

1. Field of the Invention

This invention relates to alpine ski boots having a rigid shell base topped by an upper that is at least partially journalled on the shell base, and more particularly, to apparatus affecting the interior-posterior flexion of the upper.

2. Description of Background and Relevant Information

Conventional alpine ski boots having a rigid shell base include an upper that is forwardly inclined with respect to the vertical at a given angle generally called the "advance angle", the value of which is in the range of approximately 13–20°. The optimum advance angle depends upon the conditions of use of the boots, such as competition, the nature of the terrain, quality of snow, etc, and upon the morphology of the skier. For this reason, it is desirable to be able to vary the advance angle at will. Numerous solutions have been developed; and as a result, most of the alpine ski boots in current use include expedients for adjusting the advance angle.

European Patent Office Publication Nos. 205,127 and 071,055, as well as French Patent No. 2,276,850, each discloses apparatus for modifying the angular position of the front element of an upper of a rear entry ski boot, and consequently, the tibial support afforded by the boot to the lower leg of the skier. In such apparatus, however, modification of the advance angle requires a corresponding adjustment of the closure means by which the upper of the boot is held on the lower leg of the skier. That is to say, the approach position of the rear element, or rear spoiler, of the upper of the boot, must be adjusted with respect to the front element or cuff of the boot each time the advance angle is adjusted.

Other boots, such as those described in Italian Patent No. 194,289 and European Patent Office Publication No. 133,237, utilize apparatus that permit modification of the angular position of the cuff with respect to the shell base followed by modification of the rear spoiler. Such apparatus do not modify the conditions of closure of the upper on the lower leg as previously described, but vary the amplitude of flexion by reason of the change of the relative position of the cuff with respect to the shell base in a manner inversely proportional to the value of the advance angle, i.e., maximum advance-minimum amplitude and vice versa.

It is an object of the present invention to provide an alpine ski boot whose adjustment apparatus for the advance of the upper with respect to the shell base achieves a constant amplitude of flexional movement for each of the angular positions of the upper on the shell base.

SUMMARY OF THE INVENTION

An alpine ski boot according to the present invention comprises a rigid shell base for receiving the foot of the skier, said base having a heel region and an instep region. An upper having shoulder means thereon is journalled on the base for pivotal movement about a journal axis. Adjustment apparatus is provided for controlling the advance angle of the upper on the base. The adjustment apparatus includes stopping means having a first stopping element positioned on the base and cooperable with the shoulder means for defining the minimum initial advance angle of the upper. The adjustment apparatus further includes adjustment means for adjusting the position of the stopping element on the base to thereby adjust the initial advance angle of the upper.

Preferably, the adjustment apparatus of the present invention includes a displacement guide movably mounted on the shell and carrying the first stopping element. The adjustment means for adjusting the position of the stopping element is constructed and arranged so as to releasably hold the displacement guide at a preselected position on the shell. The displaceable guide may be pivotal on the base about a pivot axis coinciding with the axis about which the upper is journalled on the base. Furthermore, the displacement guide may include a pair of legs interconnected by a bridge, the legs straddling the base and being pivotally mounted thereon. In one form of the invention, the bridge overlies the heel region of the base; and in another embodiment, the bridge overlies the instep region of the base.

The shoulder means on the upper may be constituted by a flange that bears against and slides on a bearing surface on the bridge in response to pivotal movement of the upper on the base. The engagement of the flange with the first stopping element establishes the initial minimum advance angle of the boot. In a further embodiment of the invention, the stopping means of the displacement guide may include a second stopping element spaced from the first stopping element and positioned to engage the flange for limiting pivotal movement of the upper on the base to a predetermined flexion angle relative to the minimum initial advance angle.

According to one aspect of the invention, the flexion angle is fixed; and according to another aspect of the invention, the flexion angle is adjustable. This possibility of adjustment thus permits modification of the spacing between the stopping elements for effecting a variation in the amplitude of the flexion angle of the upper permitting the boot to be adapted to the requirements of the skier under various conditions.

According to another aspect of the invention, the displacement guide may extend over all or portions of the surface of the lower edge of the upper and be journalled to the shell by means of rivets which form the journal axis of the upper. In this case, the displacement guide may be adapted, for example, to cover the instep region of the boot. Alternatively, in case of a boot having a conventional front opening, the invention can be applied to the rear zone of the shell base corresponding to the heel region thereof. In a further embodiment, a shock absorption system can be associated with the apparatus for adjusting the advance of the upper with respect to the shell base.

BRIEF DESCRIPTION OF THE DRAWINGS

Non-limiting examples of several embodiments of the boot according to the present invention are shown in the accompanying drawings wherein.

DESCRIPTION OF PREFERRED EMBODIMENTS

Figure 1:
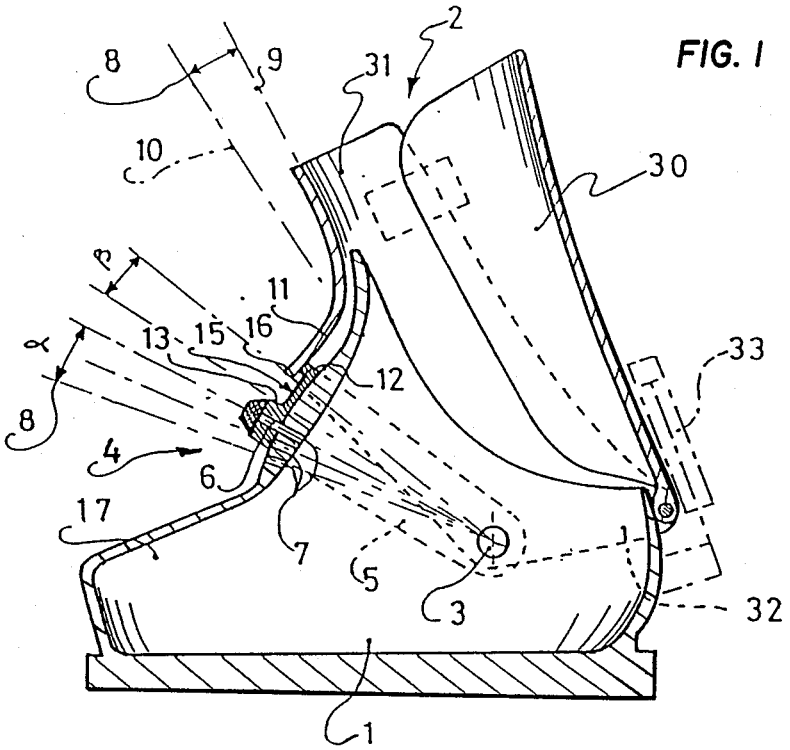
FIG. 1 is a vertical cross-section of the ski boot having a rigid shell and equipped with adjustment apparatus according to the present invention on the front portion of the shell base of the boot.

Referring now to the drawings, reference numeral 1 in FIG. 1 designates a rigid shell base of a boot topped by upper 2 having a front lower portion that overlies the base and having a rear portion journalled on the base by means of journal rivets 3 positioned approximately at the level of ankle of the skier. In this example, upper 2 is constituted by two upper elements: front cuff 31 journalled on rivets 3 on the shell base for pivotal movement about a journal axis, and rear spoiler 30 which, itself, is journalled on rear extension 32 of the front cuff for pivotal movement about a spoiler axis rearwardly of the journal axis. Adjustment apparatus 4, for adjusting the advance angle, is interposed between shell base 1 and the forward covering zone of upper 2 on lower portion 11 of front cuff 31. This apparatus 4 comprises U-shaped displacement guide 5 having spaced legs that are mounted on journal rivets 3, and a bridge connecting the legs for limiting flexion of upper 2 by means of the interaction of retention element 16 formed on an edge of lower portion 11 of cuff 31 and stopping elements on the bridge. Retention element 16 is in the form of a shoulder having a free edge slidably engaged with slide surface 15 of the bridge. Element 16 is positionable anywhere between stopping elements 12 and 13 and is cooperable with stopping elements 12 and 13 for limiting forward and rearward angular displacement of the upper.

Adjustment means are provided on displacement guide 5 for fixing its angular position on the upper portion of shell base 1. According to one embodiment, the adjustment means are constituted by a removable pin 6 projecting from the bridge of guide 5 and directed radially towards the axis about which the upper pivots. Pin 6 is cooperable with a selected one of the plurality of complementary holes 7 in the upper wall of shell base 1, these holes being radially directed with respect to the axis about which the upper pivots.

Holes 7 are angularly spaced, one from the other, to define a circular arc subtending an angle alpha measured about the axis of rivets 3 and defining the range of angular adjustment in the minimum advance angle of the boot. Hole 7, closest to lower portion 11 of upper 2, establishes the minimum initial advance angle 9 when shoulder 16 is engaged with stop element 12; and hole 7, which is most distant from portion 11, establishes the maximum initial advance angle 10 when shoulder 16 is engaged with stop element 13. For a given angular position of the displacement guide, the angle beta is the angle through which cuff 31 is pivotal on rivets 3 by reason of the permitted movement of element 16 on lower portion 11 of cuff 31 between stopping elements 12 and 13. The angle beta thus represents the flexion angle of the boot through which upper 2 can pivot about rivets 3.

The bridge of displacement guide 5 constitutes a slide surface 15 concentric with rivets 3, and on which the free end retention element 16 is slidable. As indicated above, the extent to which element 16 can be displaced on slide surface 15 is angularly defined by stopping elements 12 and 13. The shapes of shell base 1, the bridge of displacement guide 5, and lower portion 11 of cuff 31 of upper 2 are sufficiently complementary in the covering zone and zone of cooperation. Thus, the upper is displaceable through to a predetermined fixed amplitude of flexional movement independently of which of hole 7 is engaged by pin 6. In summary, the spacing, between stopping elements 12 and 13 of adjustment apparatus 4 establishes the flexion angle beta which is the angle through which upper 2 pivots on base 1, and the range of angular positions of apparatus 4 on this shell establishes the angle alpha which is the angle through which the minimum advance angle can be changed.

Figure 2:
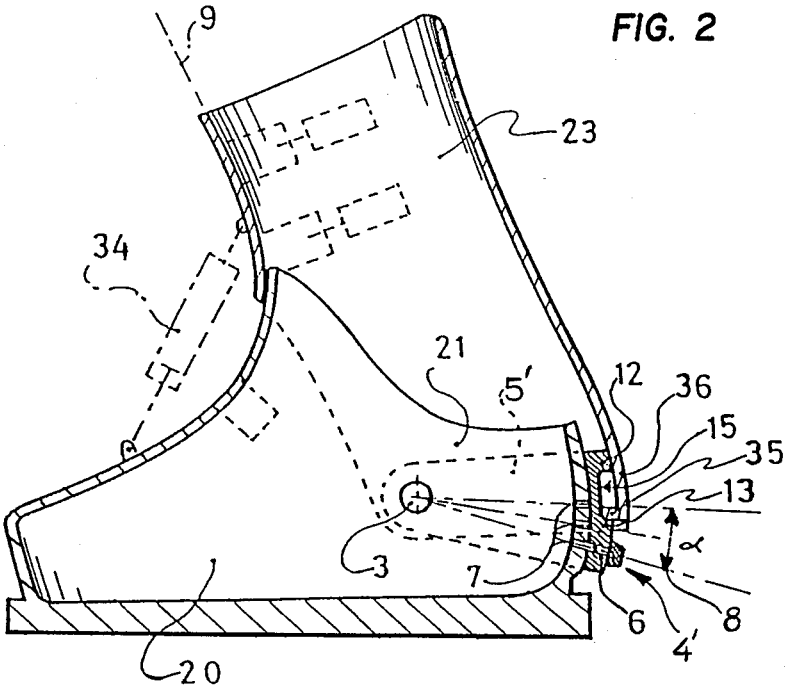
FIG. 2 is a vertical cross-section of a ski boot having a rigid shell base and equipped with adjustment apparatus according to the present invention on the rear portion of the shell base of the boot.

In FIG. 2, adjustment apparatus 4′ associated with rear portion 21 of shell base 20 of a boot. In this embodiment, all of the constituent elements of adjustment apparatus 4 previously described with reference to FIG. 1 are analogus, and need not be developed further at this point. In this embodiment, the upper also pivots on journal 3; but, the concentric surfaces are complementary shapes cooperable with a covering zone located in the heel region of the boot rather than in the instep region as shown in FIG. 1. Thus, upper 23 cooperates with displacement guide 5A overlying the heel of shell base 1. Retention element 35, constituted by he flanged free edge of rear lower portion 36 of upper 23, is slidable on slide surface 15 of the bridge of guide 5′ between stopping elements 12 and 13. This structure of the adjustment apparatus adapts itself better to a ski provided with a "front opening" type of upper, which is distinguishable from upper 2 as shown in FIG. 1 which is a "rear opening" type. In the latter case, rear spoiler 30 is pivotal on lateral extensions 32 of front cuff 31.

The present invention is thus adaptable to adjustment apparatus for either front or rear opening of types of boots. Furthermore, the operation of the adjustment apparatus does not exclude the use of known control and shock absorption systems associated with the flexion of the upper of a ski boot. For example, FIG. 1 schematically shows control and shock absorption system 33 on the rear of a boot for biasing the upper in a direction toward its minimum advance angle; and FIG. 2 schematically shows system 34 located at the front of a boot.

Within the scope of the present invention, a rear entry type of ski boot such as shown in FIG. 1 can be provided with adjustment apparatus situated at the rear of the boot in the zone corresponding to the heel of the skier such as shown in FIG. 2 for controlling the advance angle. Thus, in FIG. 3, adjustment apparatus 40 is positioned on rear portion 41 of shell base 42 of a rear opening boot. Apparatus 40 includes displacement guide 43 pivotally mounted on journal axis 3 and provided with slide surface 44 having two end abutments 45, 46 which constitute stopping elements that limit flexion of upper 47 of the boot. Upper 47 has rear spoiler 48 journalled on transverse pin 51 located on rear extension 50 of front cuff 49 and defining a spoiler axis. Pin 51, which constitutes shoulder means, cooperates with abutments 45 and 46 for limiting the advance angle of the boot.

Figure 3:
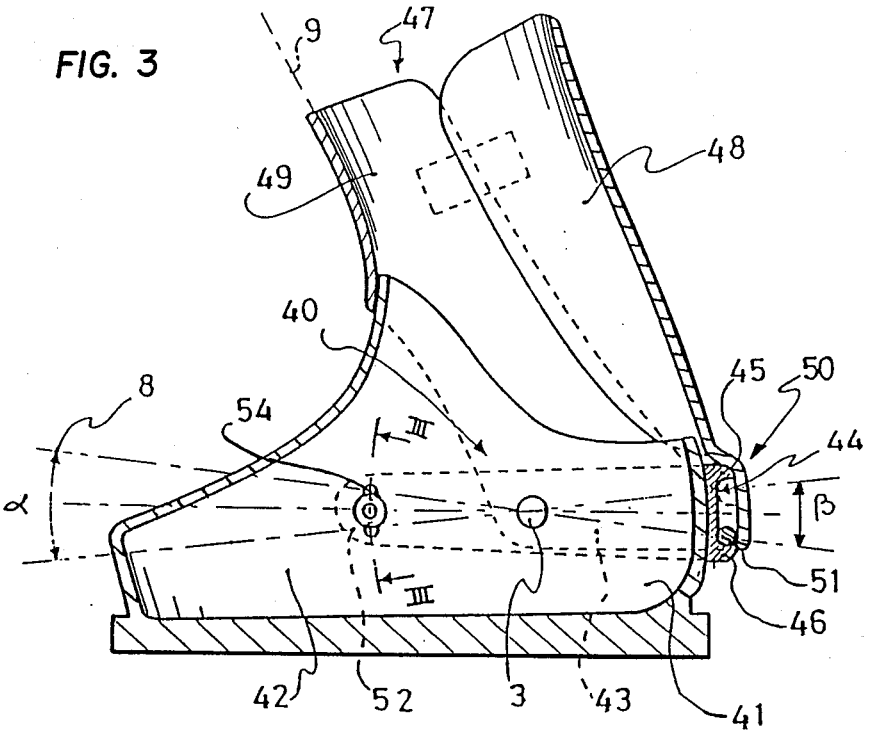
FIG. 3 is a vertical cross-section of a ski boot showing another embodiment of the adjustment apparatus adapted to the rear portion of the shell base of a rear entry ski boot.
Figure 3A:
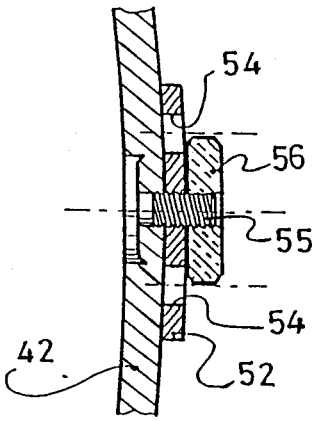
FIGS. 3*a* and 3*b* are cross-sections taken along the line III—III of FIG. 3 but showing alternative embodiments of the adjustment means for controlling the angular position of the displacement guide on the shell base during flexion of the upper.

In the embodiment of FIG. 3, displacement guide 43 comprises a pair of lateral extensions or legs 52 located on respective sides of the boot, and a bridge interposed between upper 47 and shell base 42. The bridge carries slide surface 44 slidably engaged with pin 51 and located between abutments 45, 46. The free end of each leg 52 is provided with a plurality of holes 54 constituting adjustment means cooperable with threaded bolt 55 held in a fixed position on the shell base (FIG. 3*a*). Holes 54 are spaced, one from the other, along an arc of a circle concentric with journal axis 3 about which cuff 49 is pivotal, and extending in a circular sector that defines the range of adjustment for the initial advance angle 9 of the upper. Each leg 52 of guide 43 is retained in a selected position on the shell base by means of nut 56 threaded onto bolt 55 which serves to clamp the leg to the shell base.

To modify the angular position of upper 47 on shell base 42, each extension 52 is disengaged from bolt 55 and the legs are spread to clear the bolts permitting displacement guide 43 to pivot about axis 3 until bolts 55 are aligned with another of holes 54. At this point, nuts 56 are tightened on bolts 55 to retain guide 43 at its newly selected angular position on the base. As shown in FIGS. 3 and 3*a*, three angular positions are provided for the displacement guide and thus for the minimum advance angle 9 of upper 47. However, to provide for a greater degree of adjustment of the minimum advance angle 9, arcuate opening 57 (FIG. 3*b*) in each of extensions or legs 52 may replace the three holes described above. In such case, opening 57 is concentric with journal axis 3.

Figure 3B:
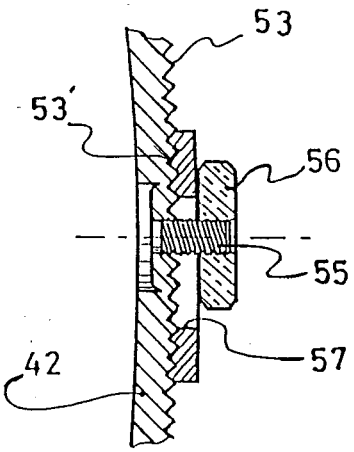

The degree to which extension 52 remains at a fixed angular position on shell 42 depends on the force exerted by tightening nut 56 on threaded bolt 55. To ensure that the legs remain fixed relative to the base, retention means on shell base 42 may be provided to cooperate with complementary means on legs 52 of guide 43. By way of example, as seen in FIG. 3*b*, the retention means may be constituted by grooves 53, 53' respectively formed on legs 52 of the guide and on shell base 42 in the vicinity where the legs engage the shell base. Preferably, the grooves are radially disposed and merge in the direction of journal axis 3. The length of arcuate opening 57 is selected to cover an angular sector equivalent to that of the desired adjustment of the advance angle.

Figure 4:
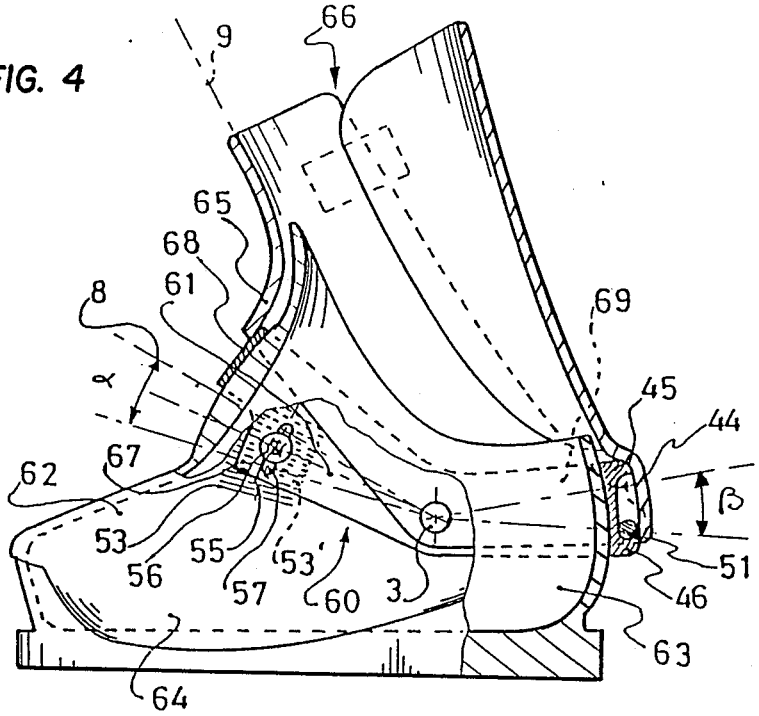
FIG. 4 is a partial longitudinal cross-section of an alpine ski boot, partially in section, with adjustment apparatus overlapping both the front and rear portions of the shell base in zones covering the lower portion of the upper.

In adjustment apparatus 60 illustrated in FIG. 4, displacement guide 61 is configured like a collar that is journalled on shell base 64 on journal rivets 3. Front arc 68 of the collar overlaps front portion 62 of shell base 64 in a zone covered by lower portion 65 of upper 66, and rear arc 69 overlaps rear portion 63. Front arc 68 and rear arc 69 are concentric with the axis of rivets 3. In this embodiment, the constituent elements of adjustment apparatus 62, other than the shape of the front arc of guide 61, are analogous to those described with reference to FIGS. 3 and 3*b*, and their description is not repeated.

The size of minimum advance angle 9 of upper 66, as previously described, is dependent on the angular position of guide 61 of adjustment apparatus 60 on shell base 64. Portion 62 of shell base 64 corresponds to the instep region of the shell and has a shape complementary to front arc 68 with which it cooperates. Portion 63 of the shell base corresponds to the heel region of the shell and cooperates with rear arc 69 of the shell base. Thus, both regions of the base have shapes that are complementary to corresponding portions on guide 61, and are thus concentric with journal rivets 3. Such a construction of adjustment apparatus 60 makes possible, if desired, the application to upper 66 of a particular frictional characteristic so as to either facilitate or brake displacement of lower portion 65 of upper 66 relative to guide 61 during flexional movement of the upper. Alternatively, or in addition, a seal may be interposed between upper 66 and the shell base as shown in U.S. Pat. No. 4,665,635.

Figure 5:
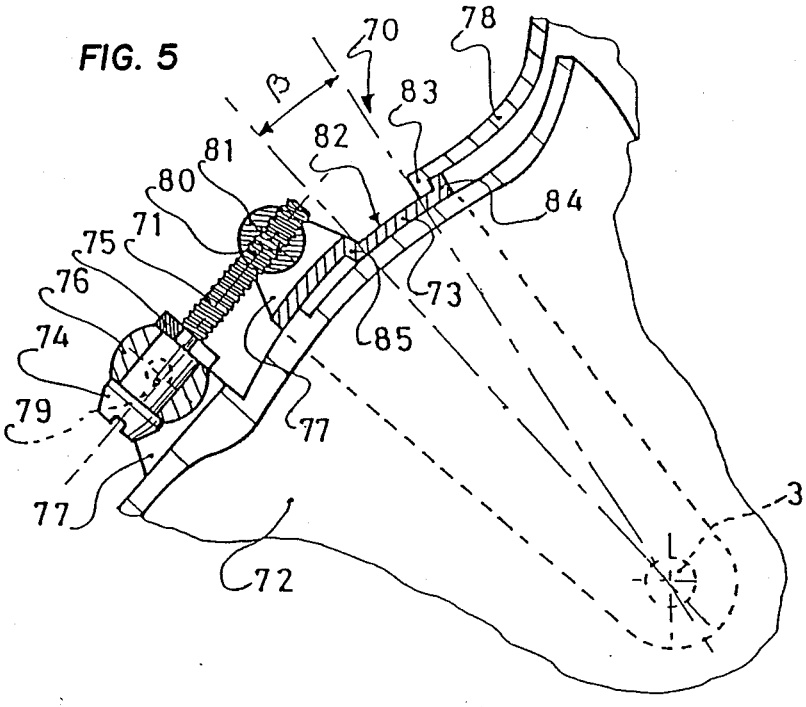
FIG. 5 is a constructional detail of adjustment means by which the angular position of the displacement guide on the shell base can be adjusted.

In each of the above described embodiments, the adjustment means for the displacement guide involves two separate elements, one on each side of the shell base. However, adjustment to, and retention in position of, a displacement guide of the adjustment apparatus can be achieved by a single means as illustrated in FIGS. 5-13. In FIG. 5, adjustable apparatus 70 includes single screw 71 located in the longitudinal median plane of the boot. In this embodiment, screw 71 is located on the upper front portion of shell base 72 and is oriented in a direction perpendicular to journal axis 3 of upper 78. The engagement of enlarged head 74 of the screw with one end face of transverse shaft 26, and the engagement of snap ring 75 on the screw with the opposite end face of shaft 76, which is oriented in a direction perpendicular to screw 71 and which contains a smooth bore through which the screw passes, holds screw 71 against longitudinal movement relative to the shell base. Shaft 76 is mounted by its axial ends 79 on shell base 72. These ends are pivotal in projections 77 that extend from the shell and constitute a cap.

Guide 73 carries an analogous assembly. Thus, threaded end 80 of screw 71 is screwed into shaft 81, which is oriented in a direction perpendicular to the screw and which is pivotally mounted in projections 77 on displacement guide 73. In this embodiment, as in the preceding embodiments, displacement guide 73 includes slide surface 82 engaged with retention element 83 in the form of shoulder means formed by the free edge of the lower portion of upper 78. Two stopping elements 84 and 85 are provided on guide 73 in the form of shoulders which define the angular extent of slide surface 82. Shoulder means 83 cooperate with the two stopping elements through two support zones which define the thickness of the guide.

To modify the angular position of guide 73 on the shell base, and thus to modify the minimum initial advance angle of upper 78, screw 71 is merely rotated in the appropriate direction causing pivotal shaft 81 to either approach or move away from pivotal shaft 71 which is fixed in position on the shell base. Consequently, rotation of screw 71 causes guide 73 to pivot about journal axis 3 but the flexion angle beta remains fixed by reason of the cooperation between shoulder 83 and stopping elements 84, 85.

Figure 6:
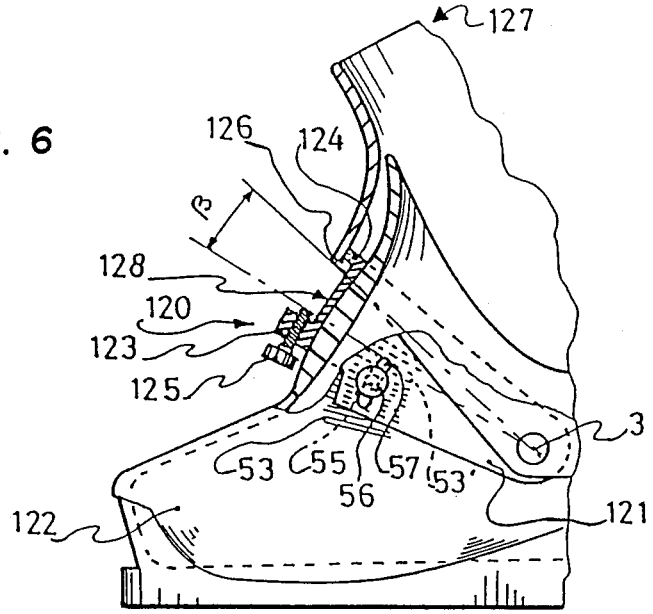
FIGS. 6 and 7 show construction details of an adjustment means that operate in reciprocal ways for varying the angular position of the upper.
Figure 7:
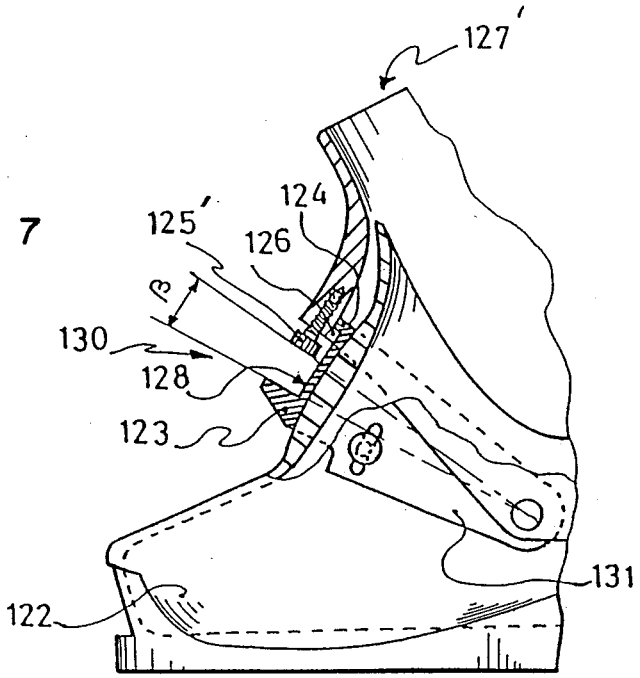

In the embodiment of the invention shown in FIGS. 6 and 7, the flexion angle beta is adjustable. In FIG. 6, displacement guide 121 of adjustable apparatus 120 comprises two stopping elements 123, 124 which define the limits of slide surface 128 that slidably engages retention element 126 in the form of a shoulder on upper 127. Stopping element 123 on guide 121 is constituted by an abutment having a portion movable with respect to stopping element 124. For example, the movable portion may be one end of screw 125 threaded into the abutment, and adjustable in position with respect to the stopping element 124. Screw 125 is an integral part of element 123 and constitutes the support zone that cooperates with shoulder 126 on upper 127, and limits forward flexion of the upper. Rotation of screw 125 makes it possible to selectively vary the magnitude of the flexion angle beta by reason of changing the point at which shoulder 126 engages the screw. The description of the other constituent elements of adjustment apparatus 120 is not repeated because the latter are configured in a manner analogous to the apparatus described with reference to FIGS. 1 and **3*b* Such other constituents concern, in particular, the pivotal mounting of guide 121 on rivets 3, and the adjustment means for releasably retaining guide 121 on shell base 122** at a preselected angular position.

In the embodiment of the invention shown in FIG. 7, adjustable apparatus 130 is comparable to that of FIG. 6, except that the movable portion of the stop element is constituted by screw 125' mounted on upper 127' in the vicinity of retention element 126 in the form of a shoulder on upper 127. Screw 125' thus cooperates with abutment 123 of guide 131 during forward flexion of the upper. In this embodiment, movable portion 125 forms an integral part of retention element 126 of which it constitutes the support zone and a front cooperation zone, i.e. that is directed toward shoulder 123.

The adjustment apparatus described above is concerned with the cooperation of a single retention element (i.e., shoulders 16 and 35, a pin 51 and shoulders 83 and 126 of upper 2, 23, 47, 66, 78, 127, 127' in FIGS. 1–7) with two stopping elements (i.e., shoulders 12–13, 45–46, 84–85, and 123–124 in FIGS. 1–7) on a deflection guide (i.e., guide 6, 43, 61, 73, 121, 131 in FIGS. 1–7). However, the displacement guide may be provided with two stopping elements individually adapted to cooperate with two retention elements on the upper, each stop element then being associated with a single retention element.

Figure 8:
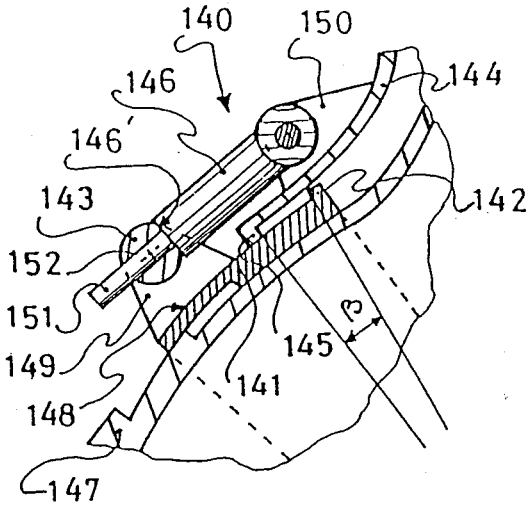
FIGS. 8–10*b* show further alternatives of the adjustment means by which the advance angle of the upper is controlled.

In the embodiment of FIG. 8, upper 144 of the boot is shown in its maximum forward flexion position. Adjustment apparatus 140 comprises displacement guide 141 whose front and rear stopping elements are constituted, respectively, by shoulder 142 and pivotal element 143 fixed to guide 141. Furthermore, upper 144 of the boot is provided with two retention elements 145 and 146. Retention element 145 is constituted by a shoulder on upper 144; and retention element 146 is constituted by a shouldered shaft carried on the upper so as to be pivotal about an axis parallel to the axis about which the displacement guide 141 is pivotal.

Stopping elements 142 and 143 of guide 141 are associated, respectively, with the retention elements 145 and 146 on the upper. The cooperation of shoulder 145 on the upper with shoulder 142 on the displacement guide during rearwardly directed movement of the upper on the shell base defines the minimum advance angle. The cooperation of shouldered shaft 146 with pivotal element 143 of the guide during forward flexional movement of the upper defines the maximum advance angle. Displacement guide 141 of adjustment apparatus 140 is journalled on shell base 147 for pivotal movement around rivets (not shown) which also serve as a journal for upper 144 of the boot. Guide 141 also presents slide surface 148 which is substantially concentric to the axis about which the guide is pivotal and which extends forwardly, from shoulder 142. Two projections 149 are provided on the front zone of slide surface 148 forming a cap on which element 143 is mounted for pivotal movement about an axis that is transverse to that of the axis about which flexion of the upper occurs.

Upper 144 presents complementary operational features with respect to stopping elements 142 and 143 on the guide. To this end, shoulder 145 is of a shape complementary to the shape of slide surface 148, and shouldered shaft 146 is mounted in a direction perpendicular to pivotal element 143 of the guide. Thus, shaft 146 is pivotally mounted on cap 150 fixed to the front portion of the upper of the boot. Furthermore, reduced end 151 projecting from shoulder 146' of shaft 146 is cylindrical and of a size that is slidably received in opening 152 in pivotal element 143. End 151 guides shouldered shaft 146 during flexion of upper 144. At the maximum forward advance of the upper, shoulder 146' abuts element 143.

As previously indicated, the minimum advance angle of upper 144 is a function of the angular position of displacement guide 141 on shell 147, and the magnitude of angular flexion angle beta of the upper is a function of the spacing between stop elements 142 and 143 of the guide, and of the spacing between respective retention elements 146 and 145 of the upper. Of course, it is possible to provide features making it possible to adjust the magnitude of the angular, flexion angle beta such as was developed with reference to FIGS. 6 and 7. In the present case, the arrangement may involve modifying the position of shoulder 146'. This is shown, by way of example, in FIG. 9 wherein adjustment apparatus 160 is similar to that of apparatus 140 of FIG. 8. In particular, apparatus 160 comprises front retention element 161 constituted by threaded shaft 162 on which tapped sleeve 163 is threaded. In order to vary the flexion angle beta, sleeve 163 is rotated on shaft 162 for displacing front support shoulder 164 of retention element 161 relative to displacement guide 141 thus affecting the extent of changes in the advance relative to the initial minimum advance angle of the upper which is fixed by the engagement of shoulder 145 with element 142.

Figure 9:
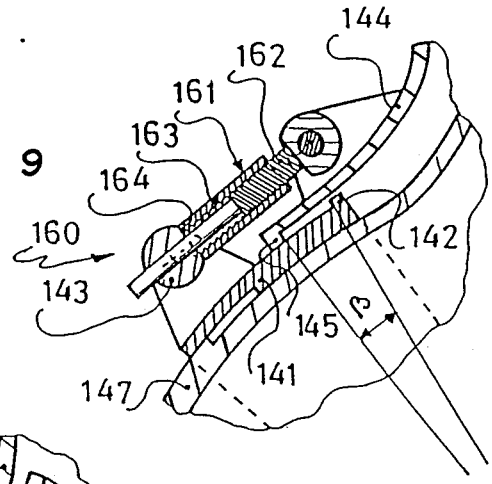
Figure 10:
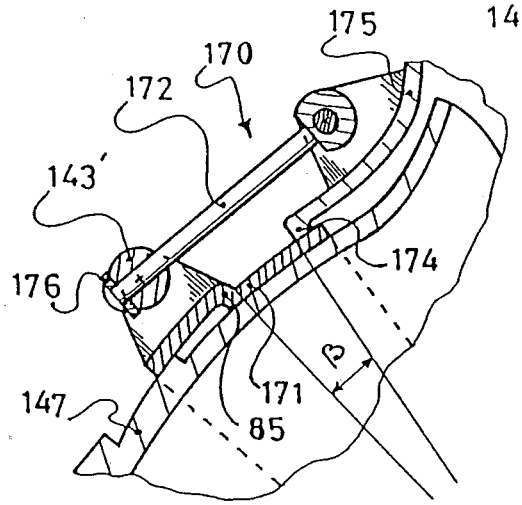
Figure 10A:
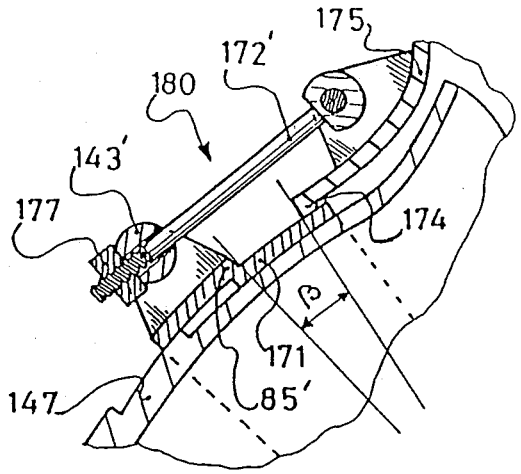

In the embodiment of the invention shown in FIGS. 10 and 10*a* adjustment apparatus 170 and 180, respectively, operate in a manner that is the inverse of what is shown in FIGS. 8 and 9. Displacement guide 171 in FIG. 10 comprises two stop elements 143' and 85' adapted to cooperate, respectively, with retention elements 172 and 174 on upper 175 of the boot. Apparatus 170 and 180 have other components that are equivalent to those described above. The novel characteristic in each of FIGS. 10 and 10*a* involves limiting rearward movement of upper 175 by the abutment of respective retention elements 172, 172' with stopping elements 143' on the displacement guides. In the adjustment apparatus of FIGS. 8 and 9, forward movement of the upper is limited by reason of stopping element 143. In FIGS. 10 and 10*a*, the forward limit of upper 175 is achieved in a manner similar to the manner that is disclosed in the embodiment of FIG. 5. That is to say, the forward limit is established by the abutment of lower edge 174 of the upper with shoulder 85' (FIGS. 10, 10*a*) In FIG. 10, adjustment apparatus 170 is provided in the form of smooth shaft 172 which extends perpendicularly through pivotal element 143' mounted on displacement guide 171. At the end of shaft 172, which projects through an aperture in element 143', snap ring 176 is mounted for abutment with element 143' when the upper pivots rearwardly thus establishing the minimum advance angle of the upper. The magnitude of the angular deflection beta of shaft 175 is thus fixed.

An adjustment to the initial minimum advance angle can be provided as shown in FIG. 10*a*. In this embodiment, adjustment apparatus 180 is provided with retention element 172' which extends through an aperture in stopping element 143' of guide 171. Nut 177 is threaded onto the free end of element 172' which projects beyond element 143'. Axial displacement of nut 177 on retention element 172' serves to vary the deflection angle beta of upper 175. In addition, such axial displacement serves to change the minimum advance angle of the boot.

Figure 10B:
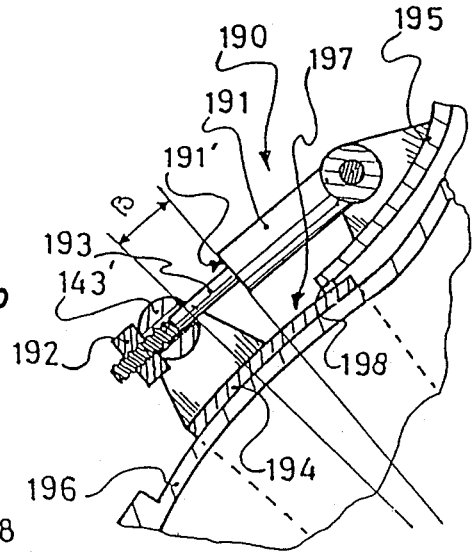

In the embodiment of FIG. 10*b*, retention element 191 of adjustable apparatus 190 is constituted by a shouldered shaft mounted in a manner comparable to that of shaft 146 of the apparatus described in FIG. 8. Nut 192 screwed on the threaded free end of reduced portion 193 on element 191 cooperates with the forward end face of stopping element 143' of displacement guide 194. Element 143' is situated between shoulder 191' of element 191 and threaded nut 192. The engagement of shoulder 191' against the rearward end face of element 143' limits forward movement of the upper relative to the shell base; and engagement of nut 192 with element 143' limits rearward pivotal movement of the upper. Thus, the magnitude of the deflection angle beta of upper 195 with respect to shell base 196 is defined by the relative position of nut 192 on boss 193 with respect to shoulder 191'.

Preferably, displacement guide 195 includes slide surface 197 which is engaged with free edge 198 of upper 195. As a further modification, nut 192 may be replaced by a snap ring such as that shown by reference numeral 176 in FIG. 10. However, FIG. 10*b*, and specifically adjustment apparatus 190, illustrates the cooperation of two retention elements, 191, 192 on upper 195 with a single element 143' on displacement guide 194 through two separate support zones, on opposite sides of stop element 143'.

Separate shock absorption systems may be associated with flexion of the upper of a boot so as to interact between the upper and the shell base as shown in FIGS. 1 and 2. However, shock absorption systems also can be incorporated into and form a part of the apparatus for controlling the advance according to the present invention wherein such apparatus is analogous to those described in the preceding examples, or which adapt arrangements and means that are comparable and equivalent.

Figure 11:
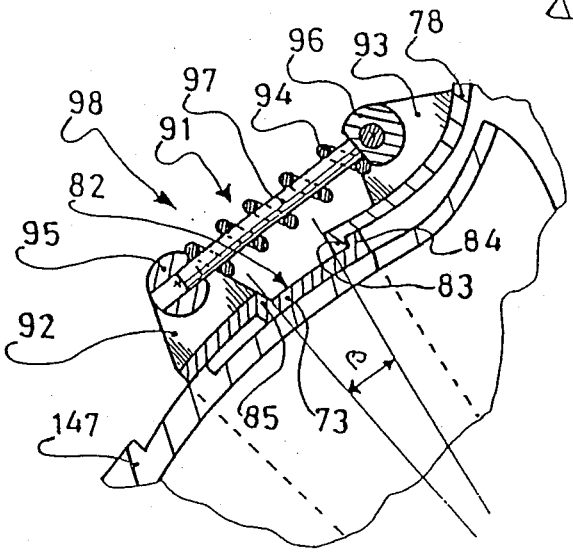
FIGS. 11–15 are embodiments of adjustment apparatus with which shock absorption means are associated for controlling the displacement of the upper with respect to the shell base.

In the example shown in FIG. 11, shock absorption system 91 is associated with adjustment apparatus 98 so as to interact between the latter and upper 78 of a boot. The displacement guide of the adjustment apparatus in this embodiment is similar to guide 73 described in FIG. 5. The remainder of the adjustment apparatus is similar to what is shown in FIGS. 8–10. Thus, the embodiment in FIG. 11 includes two caps 92, 93 attached respectively to guide 73 and upper 78. Pivotal elements 95 and 96 carried by respective caps 92 and 93 are maintained in alignment by guide rod 97, one end of which is rigidly attached to element 96 and the other end of which is slidably received in an aperture in element 96. The order of these connections can, of course, be reversed.

The magnitude of the flexion angle beta of upper 78 is established by shoulders 84 and 85 on guide 73 which cooperate with the opposite faces of shoulder 83 on the upper. Shock absorption is achieved by an elastically deformable element, such as spring 94, carried by guide rod 97 and interposed between elements 95 and 96 for maintaining a spaced relationship between caps 92 and 93. In this embodiment, shock absorption system 91 is effective for controlling forward flexional forces of the upper. To allow for movement of the upper through a deflection angle beta, which is a function of the relative spacing between abutments 84 and 85 on guide 73, spring 94 presents the possibility of total flexion greater than that caused by upper 78 and corresponding to the angle beta.

Figure 12:
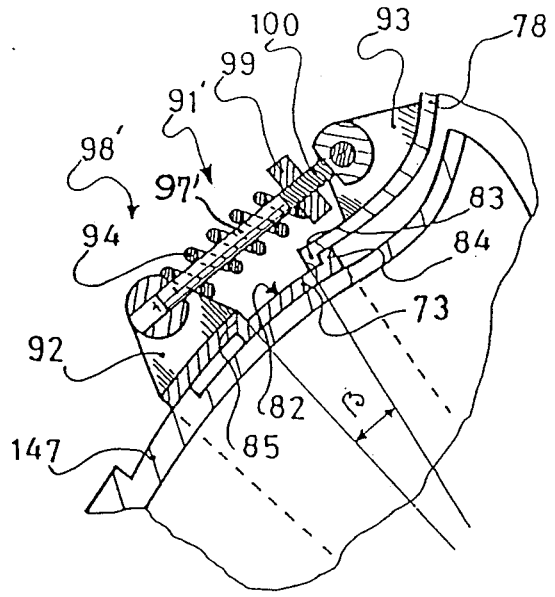

Likewise, adjustment apparatus 98' shown in FIG. 12 may include shock absorption system 91' whose spring 94 is adjustable in tension by means of an adjustment element such as nut 99 carried by threads 100 on rod 97'. The axial position of nut 99 controls the degree of prestress applied to spring 94. Of course, to allow upper 78 to rotate through the deflection angle beta, the possibility of total flexion of spring 94 will be provided at least to correspond to the extent of adjustment of the prestress added to the flexion caused by the upper.

Figure 13:
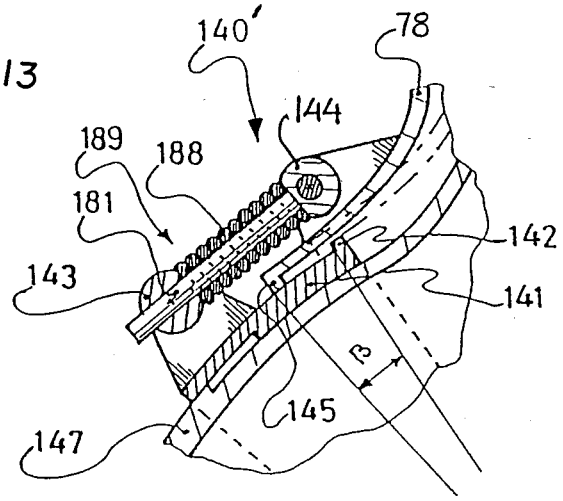

Without going beyond the scope of the invention, one of the stopping elements of the adjustment apparatus, or one of the retention elements of the upper, can be constituted, at least in part, by a shock absorption system interposed between the upper of the boot and the adjustment apparatus in order to establish a maximum rotation position of the upper either forwardly or backwardly on the shell base. FIG. 13 illustrates a first embodiment of such an adaptation where adjustment apparatus 140' is analogous to apparatus 140 of FIG. 8. Thus, apparatus 140' has the same elements as apparatus 140 with the exception of the front retention element of upper 144, and of shock absorption system 189 associated therewith. In this example, the front element is constituted by spring 188 which is mounted on guide rod 181 and is compressed solid to define the terminus of forward pivotal movement of upper 144 of the boot. Spring 188 abuts pivotal element 144 which constitutes the front stopping element of displacement guide 141 in the same manner that shouldered shaft 146 of the apparatus of FIG. 8 forms a front stopping element. The magnitude of the angular deflection beta of upper 144 is thus a function of the compressed length of spring 188.

Figure 14:
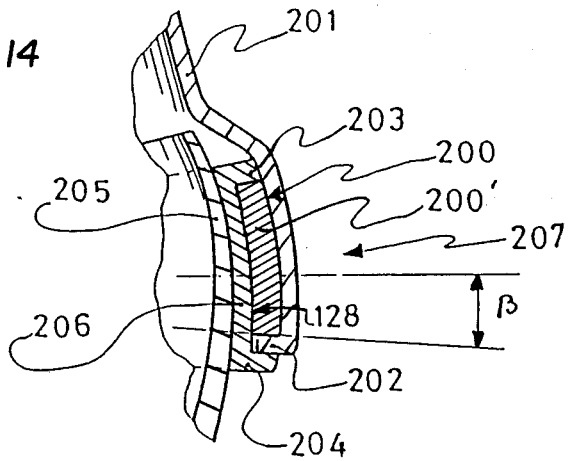

FIG. 14 illustrates a second embodiment of a shock absorption system built into the adjustable apparatus according to the present invention. System 100 includes adjustment apparatus 207 situated at the rear of shell base 25 of a boot, and is designed to establish the maximum forward pivotal position of upper 201 on the boot. To this end, elastically compressible element 200' is interposed between retention element 202 in the form of a shoulder on the rear of upper 201, and stopping element 203 on displacement guide 206 of the adjustment apparatus. In this example, another stopping element 204 on guide 206 cooperates, as was described, with retention element 202. To assure the rear support of upper 201 the magnitude of the angular deflection beta of upper 201 is a function of the elastic deformation of compressible element 200'.

Figure 15:
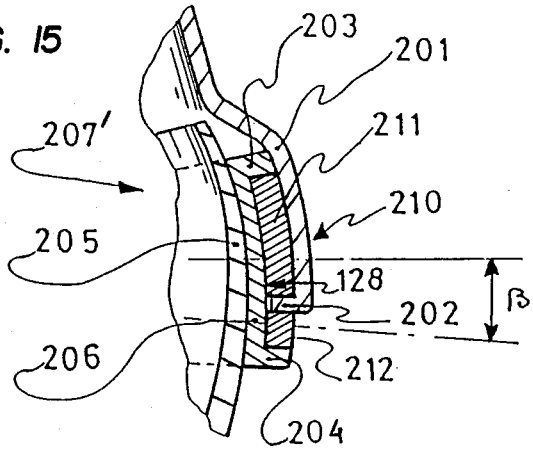

In all the embodiments of the adjustment apparatus according to the present invention described with respect to FIGS. 1–14, the minimum advance of the upper with respect to the shell base is determined by the cooperation between a retention element (such as shoulders 16, 35, 51, 83, 126, 145, 172–176, 172'–177, 192 and 202) and a stopping means (such as stopping elements 12, 46, 84, 124, 142, 143' and 204) of a displacement guide. This arrangement is preferred because, in modern alpine skiing, a firm retention support towards the rear is generally desired. It is possible, however, still within the scope of the present invention, to adopt a shock absorption system which intervenes in the sense of elastic retention of the upper of the boot towards the rear. Still within the same spirit, the initial advance position of the upper can also correspond to a position of equilibrium determined by a shock absorption system effective in both forward and rearward flexion of the upper. FIG. 15 illustrates an example of such an embodiment. The constitution of adjustment apparatus 207' is identical to that of FIG. 14 with the exception of shock absorption system 210 which comprises two elastically compressible elements 211 and 212 located on opposite sides of retention element 202 on the upper. The magnitude of the angular deflection beta is still dependent on the spacing between stopping elements 203 and 204 on the guide, but is further limited by the maximum compression of elements 211 and 212 of shock absorption system 210.

The various descriptions set forth with reference to FIGS. 8–15 define a number of possibilities of connection and cooperation between the various stopping elements of the displacement guides and the retention elements which are shoulders on the upper of a boot. Without going beyond the scope of the present invention, it is clear that the displacement guide in each of the embodiments of FIGS. 8–15 can be releasably held in a predetermined angular position on the respective shell bases by employing any of the appropriate adjustment means described in connection with FIGS. 1–9.

As described above, the present invention relates to ski boots having a rigid shell whose upper is pivotally mounted on the shell base, and in particular to ski boots provided with an upper comprising a cuff and a spoiler journalled on the latter so as to allow for insertion of a foot into the shell base. More particularly, the invention relates to adjustment apparatus by which the minimum advance angle of the upper of such boots, as well as the flexional angle of the upper, can be adjusted with respect to the shell base.

Figure 16:
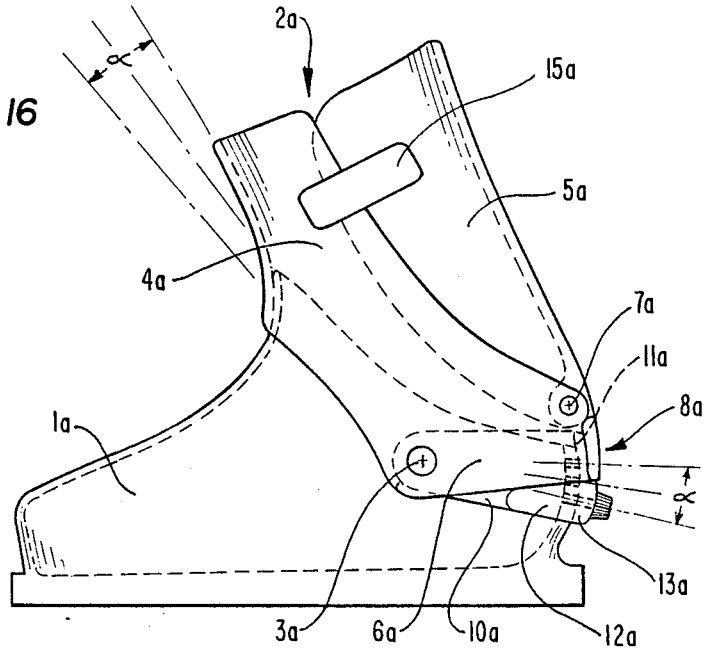
FIG. 16 is a side view of an alpine ski boot according to the present invention showing a rear entry ski boot provided with adjustment apparatus for establishing the minimum initial advance angle of the boot.

FIG. 16 shows a ski boot of this type having adjustment apparatus 8A for controlling the advance angle according to the present invention. This boot includes shell base 1A capped by upper 2A pivotally mounted on the latter about transverse journal axis 3A. Upper 2A comprises a front portion in the form of cuff 4A, and a rear portion in the form of spoiler 5A which is journalled for pivotal movement about spoiler axis 7A on lateral extension 6A of the cuff at a level adjacent the zone of the heel of the boot. According to the invention, apparatus 8A is positioned in the zone of the heel and is substantially in the form of stirrup 10A which is pivotally mounted on transverse axis 3. Stirrup 10A corresponds to the displacement guides previously described.

Stirrup 10A passes around the entire zone of the heel and includes portion 11A between shell base 1 and extension 6A of cuff 4A. The free end of lower portion 12A defines a shoulder that abuts stop element 13A on portion 11A of the stirrup and limits rearward pivotal movement of the upper on the boot to establish the minimum advance angle of the boot. In this example, and as shown in detail in FIG. 17, stirrup 11A is releasably retained in a desired angular position on shell base 1A by means of pin 16 which extends through shoulder 13A of the stirrup into one of a plurality of holes 14A in the shell base.

Holes 14A are spaced, one from another, by a certain value which determines the angle alpha whose apex is constituted by transverse axis 3. Thus, the insertion of pin 16 into different holes 14A corresponds to different angular positions of stirrup 11A with respect to the shell base. Spoiler 5A is connected to cuff 4 by conventional means, such as hook and buckle system 15A when the boot is in use. As a consequence, the entire upper 2 changes angular position with respect to the shell base.

Figure 17:
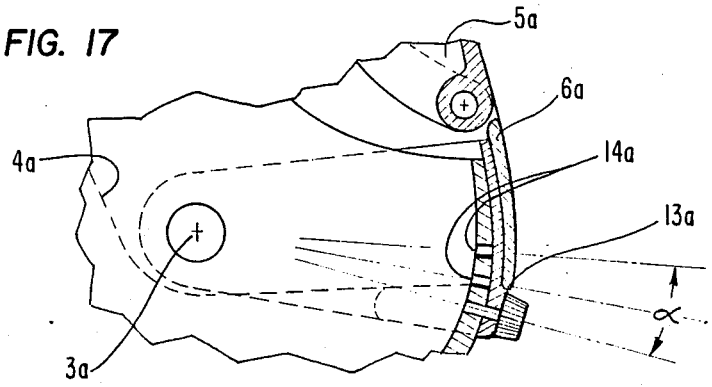
FIG. 17 is an enlarged view of the boot of FIG. 16 showing the manner in which the adjustment is carried out.
Figure 18:
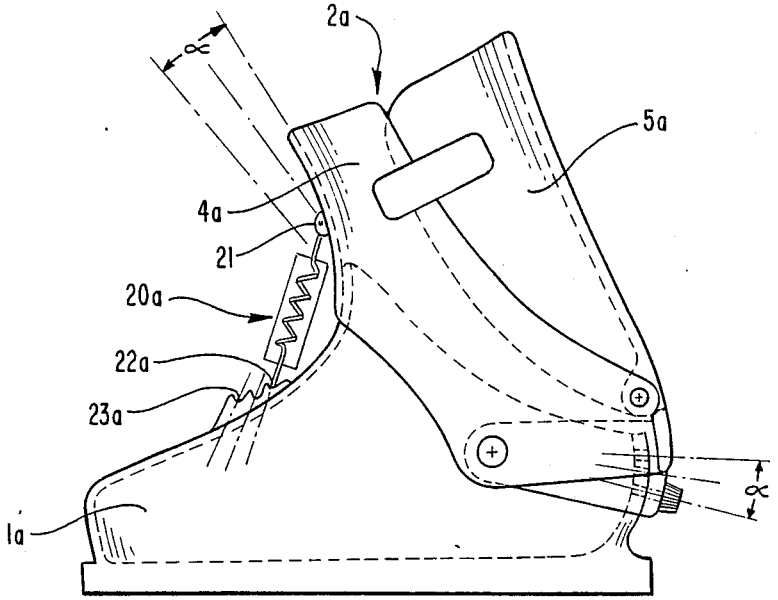
FIG. 18 is an alpine ski boot according to the present invention like that shown in FIG. 16 but including adjustable shock absorption apparatus associated with the upper.

In the embodiment of the invention shown in FIGS. 16 and 17, no control is exerted during flexion of the upper with respect to the shell base. In the example of FIG. 18, however, a ski boot according to the invention is equipped with flexion control apparatus 20A which is of a known type and comprises a shock absorber referred to as a "single effect" shock absorber. Apparatus 20A includes a spring positioned on the front portion of the boot for interacting between cuff 4A of the upper and the shell base. For this purpose, end 21A of the apparatus is connected to the upper front portion of cuff 4A. The other end 22A is connected to the shell base at anyone of several possible positions 23A. Each position corresponds to a different minimum advance angle of upper 2A.

Figure 19:
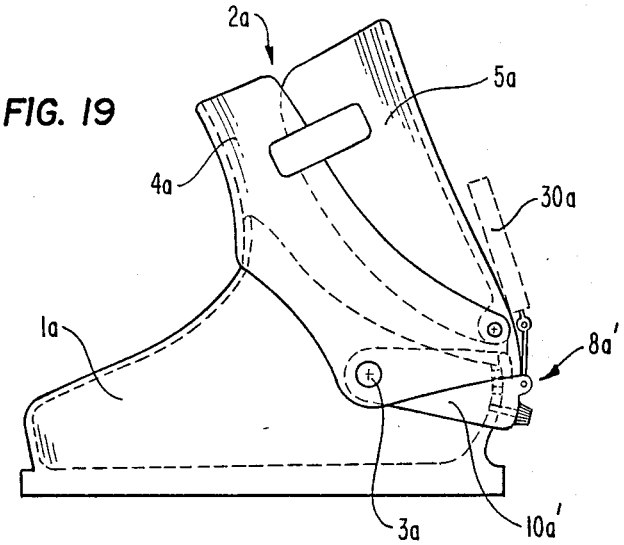
FIG. 19 is a side view of a boot according to the present invention of the type similar to that of shown in FIG. 16, but showing a different type of shock absorption apparatus.
Figure 20:
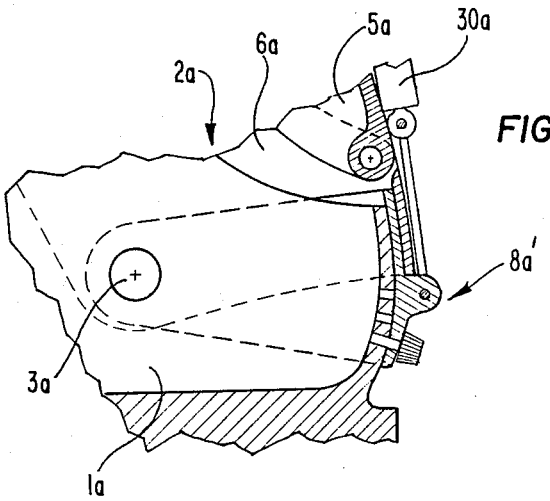
FIGS. 20 and 21 are sectional views of the boot shown in FIG. 19 illustrating the manner in which the user may change the advance angle during use.
Figure 21:
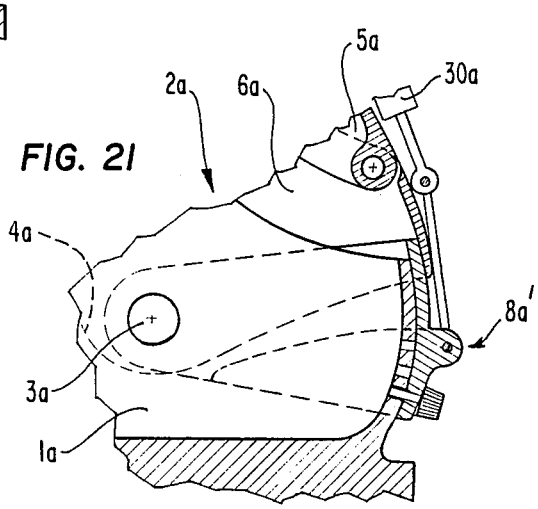

As illustrated in FIG. 19, flexion control apparatus 30 is located on rear portion 5A of upper 2A in a manner such that the apparatus interacts between upper 2A and stirrup 10A' of adjustment apparatus 8A' according to the invention. In this embodiment, apparatus 30 insures a fixed minimum advance angle because apparatus 30 rearwardly biases upper 2A. This embodiment is of particular interest because no adjustment to the position of shock absorption apparatus 30 is necessary to establish the minimum advance angle of the boot. FIGS. 20 and 21 show details of the movement of adjustment apparatus 8A', and in particular the relative positions of upper 2A with respect to the stirrup when the latter is at rest (FIG. 20) and in the course of forward flexion (FIG. 21).

Finally, although the invention has been described with reference to particular means, materials, and embodiments, it is to be understood that the invention is not limited to the particulars disclosed, but extends to all equivalents within the scope of the appended claims.

What is claimed is:

1. An alpine ski boot comprising:

(a) a rigid shell base for receiving the foot of the skier, said base having a heel region and an instep region;

(b) an upper journalled on said base for pivotal movement about a journal axis, said upper having shoulder thereon;

(c) adjustment apparatus on the base for controlling the advance angle of the upper on the base, said adjustment apparatus comprising:

(i) stopping means having a first stopping element positioned to cooperate with said shoulder means for defining the minimum advance angle of the upper; and (ii) adjustment means for adjusting the position of said stopping element on said base to thereby adjust the minimum initial advance angle of the upper.

2. An alpine ski boot comprising:

(a) a rigid shell base for receiving the foot of the skier, said base having a heel region and an instep region;

(b) an upper journalled on said base for pivotal movement about a journal axis, said upper having shoulder means thereon;

(c) adjustment apparatus for controlling the advance angle of the upper on the base, said adjustment apparatus comprising:

(i) stopping means having a first stopping element positioned to cooperate with said shoulder means for defining the minimum advance angle of the upper; and (ii) adjustment means for adjusting the position of said stopping element on said base to thereby adjust the minimum initial advance angle of the upper;

(iii) wherein said stopping means includes a displacement guide movably mounted on said shell and carrying said first stopping element, and wherein said adjustment means is constructed and arranged so as to releasably hold said displacement guide at a preselected position on said shell.

3. An alpine ski boot according to claim 2 wherein said displacement guide is pivotal on said base about a pivot axis.

4. An alpine ski boot according to claim 3 wherein said pivot axis coincides with said journal axis.

5. An alpine ski boot according to claim 3 wherein said displacement guide includes a pair of legs interconnected by a bridge, said legs straddling said base and being pivotally mounted thereon, said bridge overlying said heel region and being interposed between said base and said upper.

6. An alpine ski boot according to claim 5 wherein said adjustment means including a plurality of apertures in said base radially directed with respect to said pivot axis, and a pin mounted in said bridge and extending into one of said aperture.

7. An alpine ski boot according to claim 6 wherein said displacement guide includes a second stopping element spaced from said first stopping element and positioned to cooperative with said shoulder means for limiting pivotal movement of said upper on said base to a preselected flexion angle beta relative to said minimum initial advance angle.

8. An alpine ski boot according to claim 6 wherein said shoulder means includes a flange on said upper radially directed with respect to said journal axis and terminating in a free end, and said bridge includes a bearing surface slidably engaging the free end of said flange when said upper pivots about said journal axis.

9. An alpine ski boot according to claim 8 wherein said displacement guide includes a second stopping element spaced from the first stopping element and positioned to engage said flange for limiting pivotal movement of said upper on said base to a predetermined flexion angle beta relative to said minimum initial advance angle.

10. An alpine ski boot according to claim 9 including means for resiliently biasing said upper against pivotal movement on said base in a direction that tends to decrease the advance angle.

11. An alpine ski boot according to claim 3 wherein said displacement guide includes a pair of legs interconnected by a bridge, said legs straddling said base and being pivotally mounted thereon said bridge overlying said instep region and being interposed between said base and said upper.

12. An alpine ski boot according to claim 11 wherein said adjustment means includes a plurality of apertures in said base radially directed with respect to said pivot axis, and a pin mounted in said bridge and extending into one of said aperture.

13. An alpine ski boot according to claim 12 wherein said displacement guide includes a second stopping element spaced from said first stopping element and positioned to cooperate with said shoulder means for limiting pivotal movement of said upper on said base to a preselected flexion angle beta relative to said minimum initial advance angle.

14. An alpine ski boot according to claim 12 wherein said shoulder means includes a flange on said upper radially directed with respect to said journal axis and terminating in a free end, and said bridge includes a bearing surface slidably engaging the free end of said flange when said upper pivots about said journal axis.

15. An alpine ski boot according to claim 14 wherein said displacement guide includes a second stopping element spaced from the first stopping element and positioned to engage said flange for limiting pivotal movement of said upper on said base to a predetermined flexion angle beta relative to said minimum initial advance angle.

16. An alpine ski boot according to claim 15 including means for resiliently biasing said upper against pivotal movement on said base in a direction that tends to decrease the advance angle.

17. An alpine ski boot according to claim 5 wherein said upper includes a front cuff having a portion overlying the heel region of the base, said front cuff being pivotally mounted on said base about said journal axis, and a rear spoiler pivotally mounted on said front cuff for pivotal movement about a spoiler axis rearwardly displaced relative to said journal axis.

18. An alpine ski boot according to claim 17 wherein the rear lower edge of said heel portion of the front cuff constitutes said shoulder means.

19. An alpine ski boot according to claim 18 including means for resiliently biasing said front cuff against pivotal movement on said base in a direction that decreases the advance angle.

20. An alpine ski boot according to claim 17 including means for resiliently biasing said upper against pivotal movement on said base in a direction that tends to decrease the advance angle.

21. An alpine ski boot according to claim 20 including means for adjusting the bias on said upper.

22. An alpine ski boot according to claim 17 wherein said adjustment means includes a plurality of apertures in said base radially directed with respect to said pivot axis, and a pin mounted in said bridge and extending into one of said aperture.

23. An alpine ski boot according to claim 22 wherein the rear lower edge of said heel portion of the front cuff constitutes said shoulder means.

24. An alpine ski boot according to claim 17 including a transverse pin defining said spoiler axis, said transverse pin constituting said shoulder means.

25. An alpine ski boot according to claim 24 wherein said displacement guide includes a second stopping element spaced from said first stopping element and positioned to cooperate with said shoulder means for limiting pivotal movement of said upper on said base to a preselected flexion angle beta relative to said minimum initial advance angle.

26. An alpine ski boot according to claim 3 wherein said displacement guide includes a pair of legs interconnected by a bridge, said bridge straddling said base and being pivotally mounted thereon, and wherein said adjustment means being cooperable with said bridge.

27. An alpine ski boot according to claim 3 wherein said displacement guide includes a pair of legs interconnected by a bridge, said legs straddling said base and being pivotally mounted thereon, and wherein said adjustment means is cooperable with said legs.

28. An alpine ski boot according to claim 27 wherein said adjustment means includes a plurality of apertures in the free end of at least one of said legs, said apertures being arcuately arranged about said journal axis, and selectively engageable means for selectively engaging said apertures for establishing said initial minimum advance angle.

29. An alpine ski boot according to claim 28 wherein said selectively engageable means is in the form of a pin passing through a selective one of said aperture.

30. An alpine ski boot according to claim 27 wherein said adjustment means includes an arcuate aperture in said base adjacent to the free end of at least one of said legs, a threaded pin attached to said base and projecting through said aperture, and a nut threaded on said pin for clamping said at least one of said legs between said nut and said base.

31. An alpine ski boot according to claim 30 wherein the contacting surfaces of the base and said at least one of said legs are grooved to enhance clamping.

32. An alpine ski boot according to claim 17 wherein said displacement guide includes a pair of legs interconnected by a bridge, said legs straddling said base and being pivotally mounted thereon, and wherein said adjustment means is cooperable with said legs.

33. An alpine ski boot according to claim 32 wherein said adjustment means includes an arcuate aperture in said base adjacent at least one of said legs, a threaded pin attached to said base and projecting through said aperture, and a nut threaded on said pin for clamping said at least one of said legs between said nut and said base.

34. An alpine ski boot according to claim 33 wherein the contacting surfaces of the base and said at least one of said legs are grooved to enhance clamping.

35. An alpine ski boot according to claim 32 wherein said displacement guide includes an instep bridge that overlies and slidably engages said instep region of he base when the displacement guide pivots on said base.

36. An alpine ski boot according to claim 35 including a transverse pin defining said spoiler axis, said transverse pin constituting said shoulder means.

37. An alpine ski boot according to claim 36 wherein said displacement guide includes a second stopping element spaced from said first stopping element and positioned to cooperate with said shoulder means for limiting pivotal movement of said upper on said base to a preselected flexion angle beta relative to said minimum initial advance angle.

38. An alpine ski boot according to claim 26 wherein said bridge overlies said instep region of the base.

39. An alpine ski boot according to claim 38 wherein said shoulder means includes a flange on said upper radially directed with respect to said journal axis and terminating in a free end, and said bridge includes a bearing surface slidably engaging the free end of said flange when said upper pivots about said journal axis.

40. An alpine ski boot according to claim 39 wherein said displacement guide includes a second stopping element spaced from the first stopping element and positioned to engage said flange for limiting pivotal movement of said upper on said base to a predetermined flexion angle beta relative to said minimum initial advance angle.

41. An alpine ski boot according to claim 25 wherein said displacement guide is in the form of a collar having a front arc that overlies the instep region of the base, and a rear arc that constitutes said bridge and overlies the heel region of the base, said upper having a lower portion that engages said front arc.

42. An alpine ski boot according to claim 41 wherein said adjustment means includes an arcuate aperture in said base adjacent at least one of said legs, a thread pin attached to said base and projecting through said aperture, and a nut threaded on said pin for clamping said at least one of said legs between said nut and said base.

43. An alpine ski boot according to claim 11 wherein said first stopping element is on said bridge.

44. An alpine ski boot according to claim 43 wherein said adjustment means is associated with said bridge.

45. An alpine ski boot according to claim 44 wherein said adjustment means includes a threaded screw mounted for rotation about an axis perpendicular to said pivot axis, and threaded into a nut, said screw and nut being constructed and arranged so that rotation of said screw imparts angular displacement to said displacement guide on said shell.

46. An alpine ski boot according to claim 45 wherein said screw is rotatable on a member attached to said shell, and said nut is attached to said displacement guide.

47. An alpine ski boot according to claim 46 including a second stopping element on said bridge for cooperation with said shoulder means to establish the limit of forward flexion of said upper.

48. An alpine ski boot according to claim 11 including a second stopping element on said bridge for cooperation with said shoulder means to establish the limit of forward flexion of said upper, the flexion angle of the upper relative to said shell base being determined, at lease in part, by the relative spacing between said stopping elements.

49. An alpine ski boot according to claim 48 including means for varying the relative spacing between said first and second stopping elements.

50. An alpine ski boot according to claim 49 wherein said means for varying includes an adjustable screw on said second stopping element engageable by said shoulder means.

51. An alpine ski boot according to claim 4 wherein said means for varying includes an adjustable screw on said shoulder means engageable by said second stopping element.

52. An alpine ski boot according to claim 48 wherein said shoulder means includes a first shoulder engageable with said first stopping element to define the minimum advance angle of the upper, and a second shoulder engageable with said second stopping element to define the maximum advance angle of the upper.

53. An alpine ski boot according to claim 52 including means for adjusting said second shoulder to thereby change the magnitude of the flexion angle of the upper.

54. An alpine ski boot according to claim 52 including a rod carried by said upper and having a reduced free end, the junction between the rod and said free end constituting said second shoulder, said bridge carrying an apertured member in which said forward end of the rod is slidable during flexional pivoting of said upper.

55. An alpine ski boot according to claim 54 wherein said rod is threaded in a sleeve is threaded on said rod, and is displaceable thereon in response to rotation of said sleeve.

56. An alpine ski boot according to claim 11 including a second stopping element, both of said stopping elements being on said bridge, said shoulder means including a first shoulder engageable with said first stopping element during rearward pivotal movement of said upper on said shell for defining the minimum advance angle of the upper, and a second shoulder engageable with said second stopping element during forward pivotal movement of said upper on said shell for defining the maximum advance angle of the upper.

57. An alpine ski boot according to claim 56 including means for adjusting the position of one of the stopping elements.

58. An alpine ski boot according to claim 56 including means for adjusting the position of one of said shoulders.

59. An alpine ski boot according to claim 56 including a rod mounted on the upper and having a free end, and an apertured member having end surfaces mounted on the bridge for slidably receiving said free end during flexional pivoting of the upper on said shell, one of said shoulders being on said rod and engageable with an end surface of said apertured member which constitutes one of said stopping elements.

60. An alpine ski boot according to claim 59 wherein the free end of said rod is reduced establishing a junction that defines said first shoulder.

61. An alpine ski boot according to claim 60 wherein a sleeve is threaded on said rod.

62. An alpine ski boot according to claim 59 wherein said second shoulder is on said rod.

63. An alpine ski boot according to claim 59 wherein said first shoulder is on said rod.

64. An alpine ski boot according to claim 63 wherein said first shoulder is constituted by an element attached to the free end of said rod.

65. An alpine ski boot according to claim 64 wherein said element is threaded on the free end of said rod.

66. An alpine ski boot according to claim 59 including resilient means associated with said rod for rearwardly biasing said upper on said shell and urging said first shoulder into engagement with said first stopping element.

67. An alpine ski boot according to claim 66 including means for adjusting the bias on said upper.

68. An alpine ski boot according to claim 66 wherein said resilient means is a spring coiled around said rod, one end of said spring constituting said second shoulder.

69. An alpine ski boot according to claim 56 including resilient means for biasing said upper on said shell and urging said upper toward a minimum advance angle.

70. An alpine ski boot according to claim 69 wherein said resilient means is interposed between said second shoulder and said second stop means.

71. An alpine ski boot according to claim 5 including a second stopping element, both of said stopping elements being on said bridge and being spaced apart, said shoulder means including a flange positioned in the space between said stopping elements, and resilient means interposed between said flange and one of said stopping means.

72. An alpine ski boot according to claim 71 including resilient means interposed between said flange and each of said stopping elements.

73. An alpine ski boot comprising:

(a) a rigid shell base for receiving the foot of the skier, said base having a heel region and an instep region;

(b) an upper journalled on said base for pivotal movement about a journal axis, said upper having shoulder means thereon;

(c) adjustment apparatus on the base for controlling the minimum advance angle and the maximum flexion angle of the upper on the base, said adjustment apparatus comprising stopping means having a first stopping element positioned to cooperate with said shoulder means for defining the minimum advance angle of the upper, and having a second stopping element positioned to cooperate with said shoulder means for defining the maximum flexion angle of the upper.

74. An alpine ski boot according to claim 73 including adjustment means for adjusting the position of said stopping element on said base to thereby adjust the minimum initial advance angle of the upper.

75. An alpine ski boot according to claim 74 wherein said shoulder means on said upper has one surface that cooperates with said first stopping element to define said minimum advance angle, and another surface that cooperates with said second stopping means to define said maximum flexion angle.

76. An alpine ski boot according to claim 74 wherein said adjustment apparatus includes a slide surface interconnecting the two stopping elements, said shoulder means having a free end that is slideably engaged with said slide surface.

* * * * *